US006318119B1

(12) United States Patent
Fischer et al.

(10) Patent No.: US 6,318,119 B1
(45) Date of Patent: Nov. 20, 2001

(54) HIGH-PRESSURE GAS FRACTIONATING PROCESS AND SYSTEM

(75) Inventors: Béatrice Fischer, Rueil-Malmaison; Jean-Charles Viltard, Vienne, both of (FR)

(73) Assignee: Institut Francais du Petrole, Rueil-Malmaison cedex (FR)

( * ) Notice: Subject to any disclaimer, the term of this patent is extended or adjusted under 35 U.S.C. 154(b) by 0 days.

(21) Appl. No.: 09/471,084

(22) Filed: Dec. 23, 1999

(30) Foreign Application Priority Data

Dec. 24, 1998 (FR) ..... 98 16480

(51) Int. Cl.[7] ..... F25J 3/00
(52) U.S. Cl. ..... 62/620
(58) Field of Search ..... 62/618, 619, 620, 62/622, 627

(56) References Cited

U.S. PATENT DOCUMENTS 4,519,825 * 5/1985 Berhard et al. ..... 62/28
4,525,187 * 6/1985 Woodward et al. ..... 62/31
4,714,487 12/1987 Rowles .
4,720,294 * 1/1988 Lucadamo et al. ..... 62/31
4,921,514 5/1990 Rowles .
5,287,703 * 2/1994 Bernhard et al. ..... 62/24

FOREIGN PATENT DOCUMENTS 126309 11/1984 (EP) .
267819 5/1988 (EP) .

* cited by examiner

*Primary Examiner*—Henry Bennett
*Assistant Examiner*—Malik N. Drake
(74) *Attorney, Agent, or Firm*—Antonelli, Terry, Stout & Kraus, LLP

(57) ABSTRACT

Process allowing to fractionate a gas, wherein:

the gas is cooled from $T_0$ to a temperature $T_1$, at least part of gas phase $G_1$ is sent to an expansion stage ($X_1$) in order to obtain a mixed phase $M_2$ at a temperature $T_2$ and at a pressure $P_2$, mixed phase $M_2$ is sent to a heat exchange stage where it serves as a cooling agent, and after which it is heated, liquid phase $L_1$ is sent to an expansion stage, the heated mixed phase and the expanded liquid phase are sent to a separation stage so as to obtain a gas phase and a liquid phase, and the gas phase is fractionated by distillation performed by means of continuous heat exchange with mixed phase $M_2$, and the light constituents are extracted as gas and the heavy constituents as condensates, the fractionation stage being performed after the stage of expansion of mixed phase $M_2$.

17 Claims, 4 Drawing Sheets

HIGH-PRESSURE GAS FRACTIONATING PROCESS AND SYSTEM

FIELD OF THE INVENTION

The present invention relates to a high-pressure gas fractionating process during which at least part of the gas is expanded in order to serve as a cooling agent, expansion being carried out prior to the fractionation and scrubbing operation, the latter being carried out in a device allowing to perform simultaneously distillation and heat exchange. This device is for example a dephlegmator exchanger.

BACKGROUND OF THE INVENTION

The prior art describes various processes and industrial plants for selectively extracting propane and compounds heavier than propane, or ethane and compounds heavier than ethane.

In most cases, the gas to be processed is partly condensed, either by external low-temperature refrigeration, or by means of an expander turbine, prior to being separated in a separating drum. The liquid and vapour phases recovered are thereafter sent to a conventional multilevel distillation column. The wanted heavy compounds are recovered at the bottom of this column in the liquid form, and the scrubbed gas is recovered as vapour distillate. The condenser of the column requires very low-temperature external refrigeration.

More elaborate configurations using a dephlegmator have been described. For example, the Extrapack layout (marketed by NAT and IFP) replaces the distillation column head by a dephlegmator exchanger. An external refrigeration is still used with this configuration.

U.S. Pat. No. 4,921,514 describes a very elaborate layout using both a dephlegmator and a distillation column, the condenser using an external refrigeration cycle.

U.S. Pat. No. 4,519,825 describes a layout with a dephlegmator. The gas coming from the separator is directly sent to the high-pressure reflux pass of the dephlegmator, and the cold in the reflux exchanger is produced by the scrubbed gas that has been expanded through an expander after passage in the exchanger. This layout is suited for processing gases at a pressure below 4 MPa at the inlet.

SUMMARY OF THE INVENTION

The process according to the invention consists in proposing a new process and device configuration where the expansion operation on the gaseous fraction used as cooling agent is performed prior to the fractionating and scrubbing stage. The fractionating and scrubbing stage or separation is carried out in a dephlegmator exchanger for example.

The expression "dephlegmator exchanger" designates, for the present description, all the devices suited to carry out simultaneously a heat exchange and a distillation operation (rectification part).

Similarly, the expression "stripper exchanger" designates a device allowing to perform simultaneously heat exchanges and distillation (stripping part).

Similarly, the expression "high-pressure gas" designates a gas having a pressure at least equal to 5 MPa.

The invention relates to a process allowing to fractionate a gas comprising constituents referred to as heavy constituents and constituents referred to as light constituents, the gas being initially at a temperature $T_0$ and at a pressure $P_0$.

It is characterized in that it comprises in combination at least the following stages:

a) cooling the gas from $T_0$ to a temperature $T_1$, b) separating the gas phase $G_1$ from the liquid phase $L_1$ obtained during cooling stage a), c) sending at least part of gas phase $G_1$ from separation stage b) to an expansion stage ($X_1$) so as to obtain a mixed phase $M_2$ at a temperature $T_2$ and at a pressure $P_2$, d) sending mixed phase $M_2$ to a heat exchange stage (stage g) where it acts as a cooling agent, and after which it is heated, e) sending liquid phase $L_1$ to an expansion stage (V), f) sending the heated mixed phase and the expanded liquid phase to a separation stage in order to obtain a gas phase and a liquid phase, g) fractionating the gas phase by distillation performed by means of continuous heat exchange with mixed phase $M_2$, and extracting the light constituents as gas and the heavy constituents as condensates, the fractionation stage being carried out after the stage of expansion of mixed phase $M_2$.

The expanded liquid phase can be sent to a stabilization stage in order to obtain stabilized condensates and a gas phase $G_3$ to be fractionated, sent to separation stage f).

At least part of the scrubbed gas from fractionation stage g) is for example used as additional cooling agent for this stage.

At least part of the scrubbed gas can be used for cooling the gas during refrigeration stage a).

Stage a) is for example cooled so as to obtain a temperature below −15° C.

Expansion stage c) can be carried out to obtain a gas at a pressure below 2 MPa.

It can comprise for example a dehydration stage prior to refrigeration stage a).

It comprises for example a stage wherein said scrubbed gas is sent to a compression stage, at least one scrubbed and compressed gas fraction $G_{R1}$ is diverted, said fraction is sent to a refrigeration and expansion stage after which a mixed phase is obtained, the liquid phase is separated from the gas phase, and the liquid phase is used as reflux supplement in the distillation stage.

The gas fraction is for example cooled and liquefied to a temperature below −100° C.

The invention also relates to the system for carrying out fractionation of a gas comprising constituents referred to as light constituents and constituents referred to as heavy constituents, comprising in combination:

gas refrigeration means and a separation device at the outlet of which a gas phase ($G_1$) and a liquid phase ($L_1$) are obtained, expansion means ($X_1$) for expanding said gas phase ($G_1$), at the outlet of which a mixed phase $M_2$ at a temperature $T_2$ is obtained, said expansion means being connected by a line to a device ($D_1$, $P_1$, $P_2$) allowing to perform heat exchange and distillation, said mixed phase circulating through a pass ($P_1$), separation means ($B_1$) for separating the mixed phase after passage through the heat exchange and distillation device, expansion means (V) for expanding liquid phase ($L_1$), said expansion means being connected to separation means ($B_1$), in order to obtain a gas phase mixed with the gas phase obtained by separation of the mixed phase, all of the gas phases circulating through reflux pass $P_2$, circulation of the gas phases in passes $P_1$ and $P_2$ being a countercurrent circulation, a line intended for discharge of the liquid phases obtained by separation in $B_1$, at least one line intended for discharge of the lighter constituents in the gas form, obtained by heat exchange and distillation in device $D_1$.

The device is for example suited for heat exchange and distillation, and it comprises a third pass ($P_3$) intended for passage of at least part of the gas extracted through the line.

The device that can be suited for heat exchange and distillation is a dephlegmator exchanger ($D_1$) comprising at least two passes, including a reflux pass in which fractionation is carried out.

It comprises for example stabilization means situated after the expansion valve.

The stabilization means and the gas refrigeration means are for example included in a single device.

The means for refrigerating and the means for separating the gas to be fractionated are for example a stripper exchanger.

The system comprises for example compression means ($C_1$) for compressing the scrubbed gas, a line (50) for diverting at least a fraction of the scrubbed gas, means ($E_5$) for refrigerating and for expanding ($V_2$) said fraction and separation means ($B_2$) associated with fractionating device ($D_1$) so as to obtain a liquid phase at a sufficiently low temperature used as additional reflux in reflux pass $P_2$.

The process and the system according to the invention are notably suited for fractionation of a gas essentially comprising methane and hydrocarbons with one or more carbon atoms.

BRIEF DESCRIPTION OF THE DRAWINGS

Other features and advantages of the invention will be clear from reading the description hereafter of several embodiments of the process, given by way of non limitative example, with reference to the accompanying drawings wherein.

DETAILED DESCRIPTION OF THE INVENTION

Figure 1:
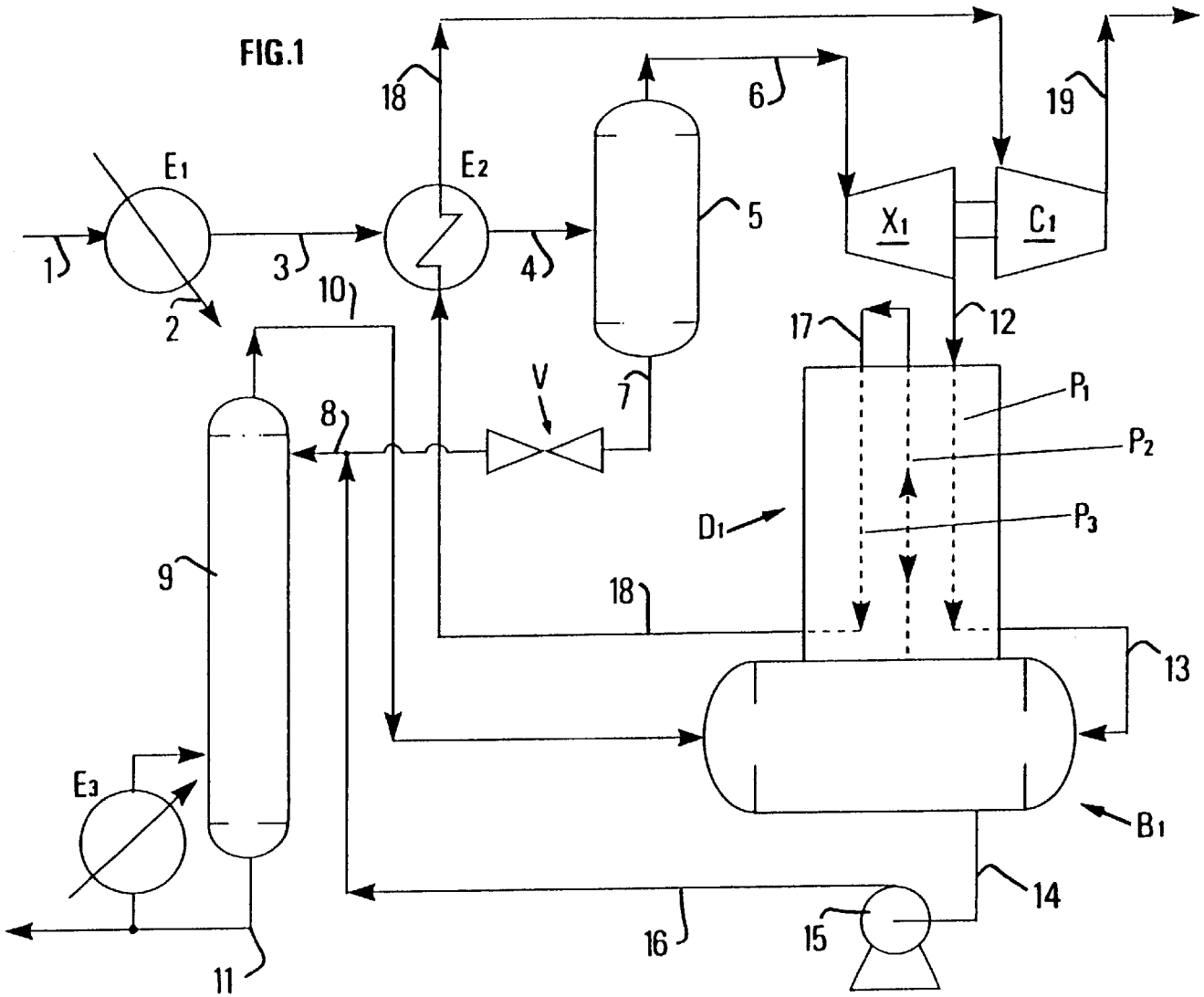
FIG. 1 diagrammatically shows the principle of the process according to the invention.

The principle of the process according to the invention is given in connection with FIG. 1 by way of non limitative example for a natural gas to be fractionated into methane/ethane on the one hand and into propane and heavier hydrocarbons on the other hand.

This natural gas is sent under high pressure $P_0$ and at a temperature $T_0$, through line 1, into a heat exchanger $E_1$. Inside $E_1$, it is cooled by heat exchange with cooling water circulating in line 2 or sea water, or air. The cooled gas fed into line 3 is then cooled in a second heat exchanger $E_2$ to a temperature $T_1$. Heat exchange is performed for example by using at least part of the scrubbed gas from the fractionating and scrubbing process according to the invention that circulates through line 18.

The cooled mixed phase containing a gas phase and condensates from exchanger $E_2$ is fed through a line 4 into a separation device, for example a separating drum 5. The condensates are separated in this separating drum, a gas phase $G_1$ is extracted from the top of the drum through a line 6 and the separated condensates or $L_1$ are extracted from the bottom of the drum through a line 7.

Gas phase $G_1$ is sent to an expansion device such as an expander turbine $X_1$ so as to obtain an essentially gaseous mixed phase $M_2$ cooled by the expansion, at a temperature $T_2$. This cooled mixed phase $M_2$ is used as a cooling agent during the fractionating and scrubbing stage carried out in the dephlegmator exchanger as described hereafter.

Liquid phase $L_1$, consisting of the condensed $C_{3+}$ and of part of the $C_1$ and $C_2$, is expanded for example through an expansion valve V. The two-phase fluid $M_3$ resulting from this expansion is for example sent through a line 8 into a stabilization column 9. A gas phase $G_3$ is discharged through a line 10 at the top of stabilization column 9, and the stabilized condensates $L_3$ are discharged through a line 11 at the bottom of the column.

The stabilization column is for example reboiled by means of a hot-oil exchanger $E_3$. Only a small amount of light products ($C_1$, $C_2$) is left in the $C_{3+}$ mixture at the bottom of the column.

The fractionating and scrubbing system according to the invention comprises an assembly including at least one dephlegmator $D_1$ associated with a separating drum $B_1$. Dephlegmator $D_1$ is for example a plate exchanger known to the man skilled in the art, which comprises passages whose size and geometry are suited for circulation of the liquid or gas phases, these passages are referred to as "passes" within the scope of the present application. Dephlegmator $D_1$ comprises at least two passes $P_1$, $P_2$, one being suited for circulation of a fluid, for example the essentially gaseous mixed phase $M_2$ coming from expander $X_1$ and used as cooling agent, and a pass $P_2$ or reflux pass where the gas to be fractionated circulates from the bottom upwards. As a result of cooling through mixed phase $M_2$, condensation occurs inside reflux pass $P_2$, the condensed liquid causes a distillation effect as it circulates back down again. The dephlegmator exchanger can also comprise a third pass $P_3$ and possibly other passes.

The mixed phase $M_2$ from turbine $X_1$ is fed through a line 12 into the first pass $P_1$ of the dephlegmator where it circulates in a descending flow according to a path shown by dotted lines in the figure. After fulfilling its cooling agent function, this mixed phase reheated to a temperature $T_3$ in relation to its inlet temperature and depleted in liquid is extracted through a line 13 and reintroduced into separating drum $B_1$ of the dephlegmator.

This mixed phase is mixed with the gas phase $G_3$ extracted from stabilization column 9 and introduced through line 10. The gas phase and the liquid phase are separated inside separating drum $B_1$.

The condensates (or liquid phase) separated in drum $B_1$ are extracted through a line 14 and sent through a line 16 by a pump 15 in order to be mixed with the two-phase mixture $M_3$ coming from expansion valve V. These condensates contain part of the liquid of the mixture that has been separated, as well as the liquid condensed in the reflux pass.

The gas phase obtained by separation in the drum is at dew point. It circulates in an ascending flow in reflux pass $P_2$ while getting colder as it advances. Inside this pass $P_2$, the liquid condensed by heat exchange with mixed phase $M_2$ circulating in a descending flow in pass $P_1$ circulates in a descending flow and causes a distillation effect. A scrubbed gas is thus obtained, which is discharged through a line 17 at the top of dephlegmator exchanger $D_1$. The scrubbed gas is at a temperature $T_4$ close to $T_2$ (temperature of mixed phase $M_2$ at the turbine outlet). This scrubbed gas has lost, in most cases, between 90 and 99% of the propane present in the feed introduced through line 1.

The scrubbed gas $G_4$ extracted through line 17 is for example reintroduced in a third pass $P_3$ of dephlegmator $D_1$ in order to be used as a second cold source. It circulates in a descending flow in $P_3$, cocurrent to the circulation of mixed phase $M_2$ and countercurrent to the direction of circulation of the gas phase separated in the dephlegmator drum. A scrubbed and reheated ($T_5$) gas stream is obtained at the outlet of this third pass $P_3$, and it is for example recycled through a line 18 to heat exchanger $E_2$. After being used as a cooling agent and therefore reheated in heat exchanger $E_2$, the gas is sent to a compressor $C_1$ prior to being exported through a line 19. Compressor $C_1$ is for example actuated by expander $X_1$.

In comparison with processes of the prior art, the process according to the invention allows to perform the desired separation or fractionation of the processed gas by means of a minimum number of equipments and without requiring an external refrigeration cycle. It therefore allows to significantly cut down the required investment, up to above 30% in some cases, and it also allows to reduce the size of the equipment. It can be readily used for offshore platform applications.

The example given hereafter illustrates the various advantages obtained by implementing the process according to the invention.

The natural gas is fed at a temperature of 80° C. and at a pressure of 7.5 MPa into exchanger $E_1$. The flow rate is 100 000 $Nm^3/h$.

Its composition, given in per cent by volume, is as follows:

| | |
|---|---|
| Methane | 33.95% |
| $CO_2$ | 0.4% |
| Ethane | 9.35% |
| Propane | 3.14% |
| Butane | 1.83% |
| Hydrocarbons ($C_{5+}$) | 1.33%. |

The gas is cooled in exchanger $E_1$ with cooling water, to a temperature of 35° C.

It is then cooled in exchanger $E_2$ by heat exchange with the scrubbed gas ($G_5$) coming from dephlegmator exchanger $D_1$, to a temperature of −18.5° C. Partial condensation occurs during this cooling stage. Separation of the liquid and vapour phases resulting from this condensation is performed in separating drum 5.

The gas phase or stripped gas from separating drum 5 is fed into expander turbine $X_1$. At the drum outlet, the stripped gas is at a pressure of 7.42 MPa and at a temperature of −18.5° C. After passing through the turbine, its pressure is 1.5 MPa and its temperature is −82° C. During this expansion stage, partial condensation occurs, which leads to a mixture $M_2$ of gas and of condensates. The mixed gas and condensates are sent to the first pass $P_1$ of the dephlegmator to be used as coolant. At the outlet of this first pass, the reheated mixture extracted through line 13 is fed into the separating drum $B_1$ of the dephlegmator in which the gas phase and the condensates are separated. The condensates or liquid phase are extracted through line 14 and pump 15. The gas phase separated in drum $B_1$ circulates with the gas phase from the stabilization stage in an ascending flow in the second pass $P_2$ of dephlegmator $D_1$.

The liquid phase extracted through line 7 is expanded through expansion valve V to a pressure of 1.5 MPa prior to being fed into stabilization column 9. The vapour phase $G_3$ extracted at the top of the stabilization column is sent to the separating drum of the dephlegmator. It is at a temperature of −24° C. and supplies the heat required for distillation in the second pass of the dephlegmator.

All of the gas phases resulting from the separation performed in separating drum $B_1$ are at dew point at the inlet of pass $P_2$ where distillation is carried out. At the end of this distillation stage, a gas stream G4 is extracted through line 17. This scrubbed gas $G_4$ is free of the most part of its propane and it is at a temperature of −79.7° C.

Gas stream $G_4$ is possibly fed into the third pass $P_3$ of the dephlegmator and serves as a secondary cold source. This gas stream $G_5$ at a temperature of −71° C. is sent through line 18 to be used as cooling agent in exchanger $E_2$. After heat exchange, the scrubbed gas reheated to a temperature of 32.5° C. is sent to compressor $C_1$ actuated by the expander turbine. At the outlet of $C_1$, the scrubbed gas is at a pressure of 2.26 MPa and at a temperature of 77° C.

The stabilization column is reboiled by means of exchanger $E_3$, either by low-pressure steam, or by hot oil. The column bottom temperature is 68° C. The column bottom liquid contains 97.6% propane of the feed and all of the butanes and the heavier hydrocarbons. A small amount of ethane is present in limited amount so that the $C_3$, $C_4$ that can be distilled from the liquid, discharged from the distillation column bottom through line 11, have a vapour pressure in accordance with commercial specifications.

Composition of the exported liquid (line 11) in per cent by weight:

| | |
|---|---|
| Ethane | 0.93% |
| Propane | 37.39% |
| Butanes | 29.4% |
| Pentanes and heavier hydrocarbons | 32.28%. |

Composition of the exported gas (line 19) in per cent by volume:

| | |
|---|---|
| $CO_2$ | 0.42% |
| Methane | 89.62% |
| Ethane | 9.88% |
| Propane | 0.008%. |

Figure 2:
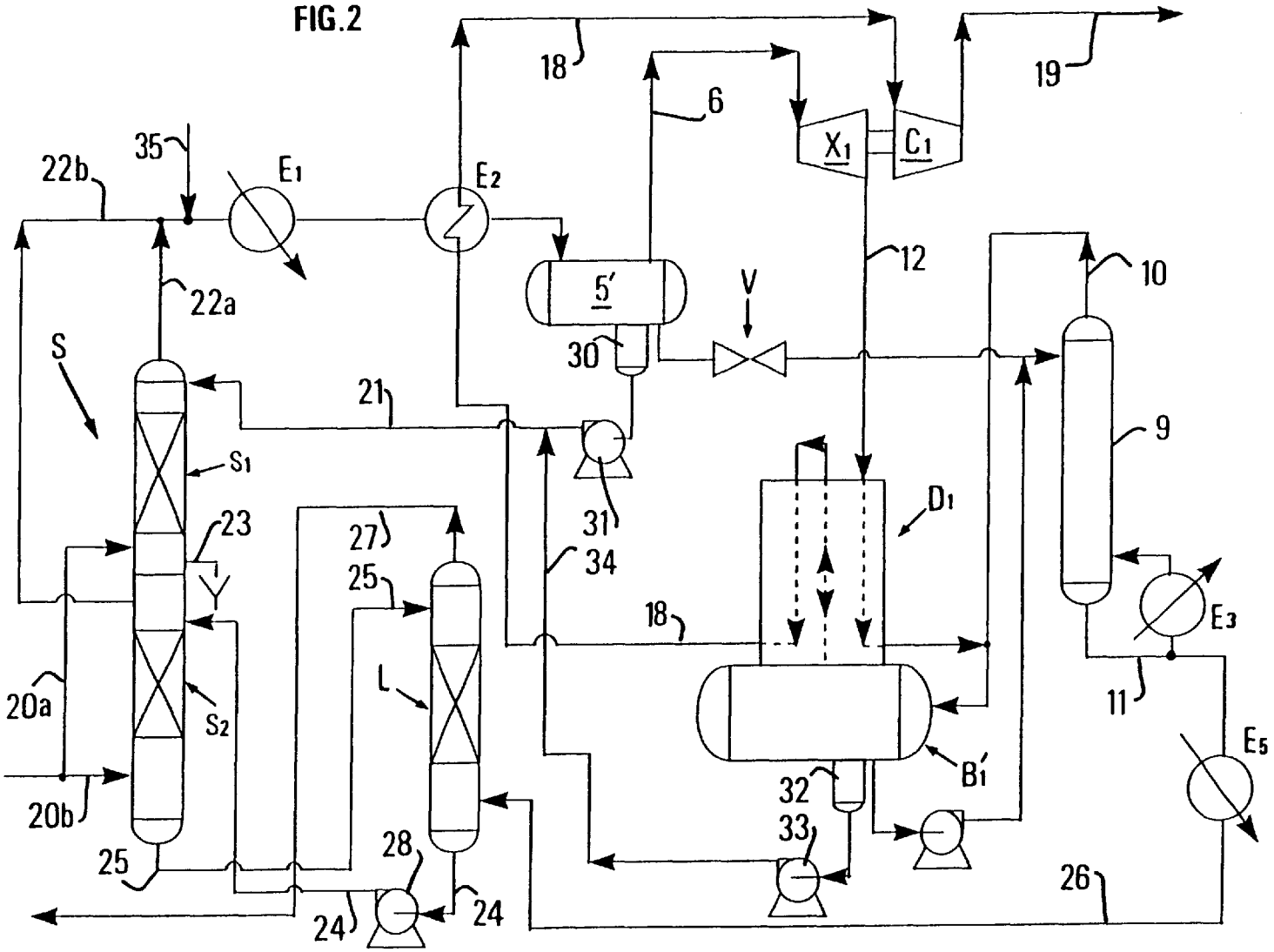
FIG. 2 shows a variant of the process including a processed gas drying stage.

FIG. 2 describes a realisation variant comprising a stage of dehydration of a wet natural gas that has not been subjected to a previous drying treatment as in the example given in FIG. 1.

The elements and the devices of the system that are similar to FIG. 1 have the same reference numbers.

A liquid phase containing water and methanol is used for dehydration of the natural gas.

In comparison with the layout described in FIG. 1, the example given in FIG. 2 comprises a column S allowing to dehydrate the gas and to regenerate the wash water used in a column L for washing the natural gas liquid or NGL (or condensates).

Column S comprises two parts, for example an upper part $S_1$ in which part of the water contained in the natural gas is eliminated, and a lower part $S_2$ suited to regenerate the wash water used for washing the NGL.

Part of the gas flowing in through line 1 is fed through a line 20*a* into the upper part $S_1$ of column S. At the top of upper part $S_1$, a liquid phase containing a solvent, methanol for example, used to dehydrate the gas or to reduce the amount of water contained in the gas, is injected through a line 21. A water-depleted gas enriched in methanol is extracted through a line 22 at the top of column S, and a water greatly depleted in methanol is extracted through a line 23 situated in the middle of the column (at the bottom of upper part $S_1$).

Another part of the gas is fed through a line 20*b* into the lower part $S_2$ of the column to regenerate the wash water from the NGL washing tower L described hereafter. The wash water is introduced at the top of lower part $S_2$ through a line 24 coming from washing column L. Methanol-enriched gas is extracted from the top of part $S_2$ of the column through a line 22*b*, and methanol-depleted wash water is extracted from the bottom of column S through a line 25 prior to being sent to the NGL washing column.

Stripping of the wash water used to wash the NGL in washing column L is thus carried out in the lower part $S_2$ of the column.

Washing column L allows to free the natural gas liquid of the methanol it contains in order to avoid methanol losses. The natural gas liquid (condensates) concerned comes from stabilization column 9 through line 11. This stream flows through a heat exchanger $E_4$ placed after heat exchanger $E_3$ prior to being fed into the lower part of washing column L through a line 26. In washing column L, the NGL are washed by means of the methanol-depleted water introduced through line 25 at the column head. The methanol-free NGL is recovered through a line 27 at the head of column L, and at the column bottom, the methanol-containing wash water is recovered and sent into line 24 and to a pump 28 in order to be stripped in the lower part of column S.

The water-depleted gas enriched in methanol coming from lines 22 and 22*b* is cooled according to a procedure similar to that of FIG. 1, through the two heat exchangers $E_1$ and $E_2$, then sent to a separation stage that is carried out in a separating drum 5' provided with a "boot tank" 30 allowing to recover the water and the methanol.

The separated water and methanol extracted from drum 5' are sent through a pump 31 into line 21 at the head of stripping column S for drying of the gas introduced at the column bottom.

The separated condensates are sent to the stabilization column according to a procedure similar to that of FIG. 1.

The gas separated in separating drum 5' and extracted through line 6 is expanded through expander turbine $X_1$. The expanded mixture still contains water and methanol as traces.

Upon cooling, a water-methanol phase settles in separating drum $B'_1$ of the dephlegmator. This drum is provided with a boot tank 32 allowing to recover this water-methanol phase that is then sent through a pump 33 and a line 34 into line 21 intended for delivery of the water-methanol phase into column S.

In the stabilization column, methanol remains in the liquid hydrocarbons at the stabilization column bottom, recovered in column L.

Makeup methanol is injected for example before exchanger $E_1$ through a line 35.

Such an embodiment is advantageously suited for a process layout such as that described in U.S. Pat. No. 4,775,395 whose teaching is mentioned by way of reference.

Figure 3:
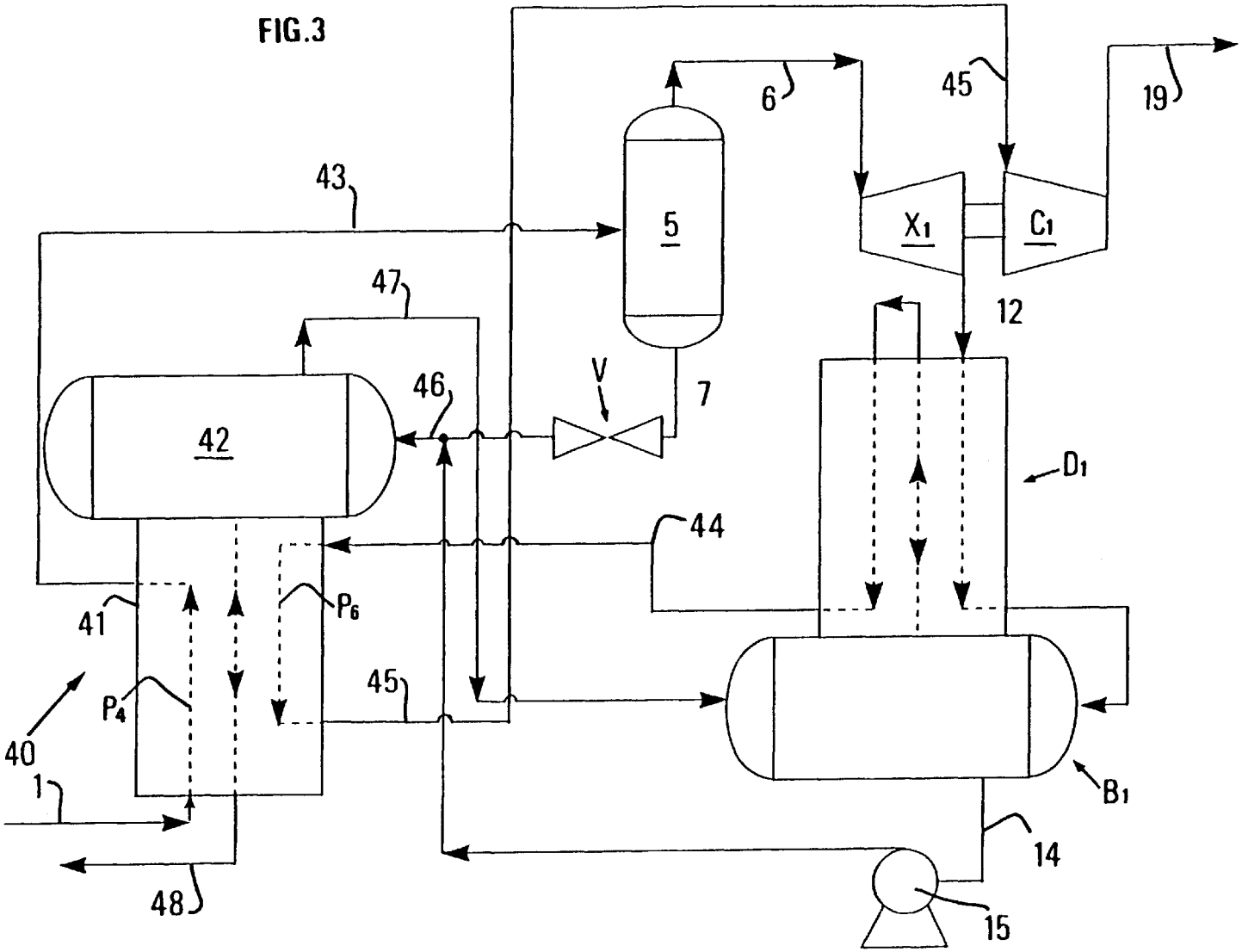
FIG. 3 shows a layout comprising a stripper exchanger, and FIG. 4 diagrammatically shows a variant of the process including a deethanization stage.

FIG. 3 shows another realisation example wherein the two heat exchangers $E_1$, $E_2$ and the stabilization column 9 of FIG. 1 are replaced by a stripper exchanger 40. The function of the stripper exchanger is notably to cool the natural gas and to stabilize the condensates.

This realisation variant allows to do without an external source for cold production.

Stripper exchanger 40 comprises a part 41 for stripping the liquid and a separating drum 42 for separating the gas phase from the condensates.

The gas is fed into line 1 in the lower part 41. It circulates in a pass $P_4$ where it is cooled prior to being discharged through a line 43 and sent to separating drum 5. Its outlet temperature is substantially identical to its temperature after heat exchangers $E_1$ and $E_2$ given for the embodiment of FIG. 1.

The scrubbed gas, after passage through dephlegmator $D_1$, is fed through line 44 into the lower part 41 of stripper exchanger 40. It circulates in a descending flow in a pass $P_6$. While circulating, it is heated by calories exchange mainly with the ascending hot gas circulating in pass $P_4$. It is thus mainly used as cooling agent for the gas to be fractionated. It flows out of this stripper through a line 45 prior to being sent to compressor $C_1$, then exported through line 19.

In the separating drum 42 of stripper exchanger 40, the condensates expanded by passage through expansion valve V and the liquid coming from drum $B_1$ and pump 15 are introduced through a line 46. In this drum 42, the gas phase is separated and extracted through a line 47 similar to line 10 in FIG. 1 prior to being sent to the dephlegmator. This gas phase corresponding to the aforementioned stream $G_3$ (FIG. 1) is fractionated according to a procedure similar to that described in FIG. 1.

The condensates that are not stabilized at bubble point and that have been separated in separating drum 5 are expanded through V, mixed with the condensates coming from $B_1$ prior to being fed into drum 42 through line 46. All these condensates are then separated into a liquid phase and a vapour phase. The liquid phase circulates in the lower part of the stripper exchanger in a stripping pass $P_5$. Vaporization occurs in this pass as a result of heat exchanges, mainly with the gas stream circulating in pass $P_4$. The vapour phase circulates upwards along pass $P_5$ while producing a distillation effect, whereas the liquid phase flows downwards prior to being discharged through a line 48 similar to line 11 in FIG. 1.

Figure 4:
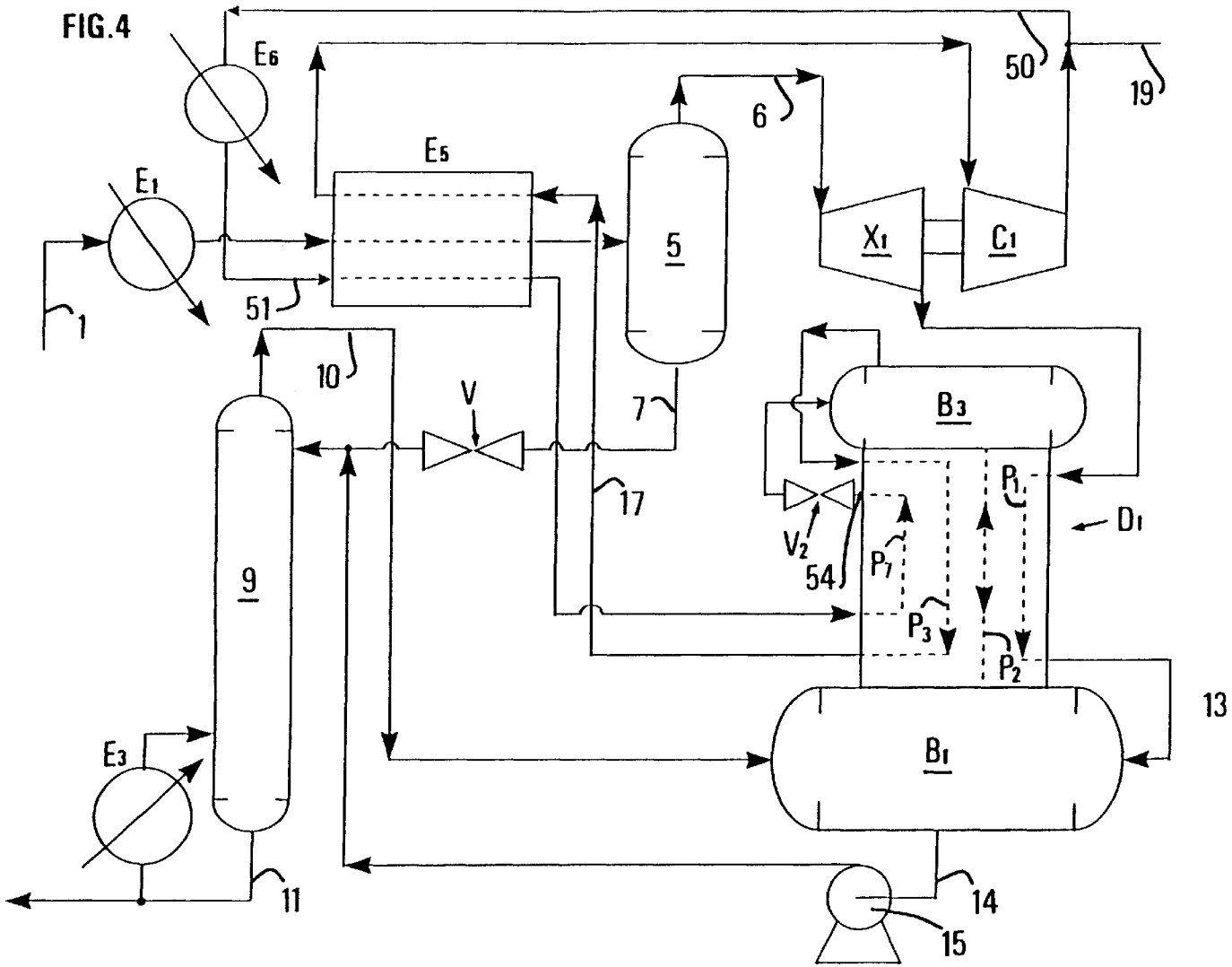

FIG. 4 diagrammatically shows another variant of the process allowing to increase the purity and in particular to separate ethane.

The layout of the various elements differs from that of FIG. 1, in particular for the following elements:

- dephlegmator $D_1$ is equipped with a drum $B_3$ placed in the upper part thereof,
- exchanger $E_2$ is replaced by a plate type exchanger $E_5$,
- presence of means 50 for diverting part of the scrubbed gas and of means $E_6$ for cooling this diverted compressed gas part or fraction.

A fraction $G_{R1}$ of the gas coming from compressor $C_1$ is fed through a line 50 into a first water or sea water or air exchanger $E_6$. This cooled gas fraction is then sent through a line 51 into an exchanger $E_5$ where it is cooled by using the scrubbed cold gas extracted through line 17 of the dephlegmator and circulating countercurrent thereto in exchanger $E_5$. This fraction $G_{R2}$ is then liquefied by circulating in an ascending flow in a fourth pass $P_7$ of the dephlegmator, extracted through a line 54 provided with an expansion valve $V_2$. A mixed phase $M_R$ comprising a liquid phase and a gas phase at very low temperature is obtained at the outlet of this expansion valve. This mixed phase $M_R$ is fed into separating drum $B_3$ in order to be separated into a gas phase and a liquid phase $L_R$. The separated gas phase is mixed with the gas coming from reflux pass $P_2$, the mixture thereof being extracted through line 17.

Liquid phase $L_R$ is used as additional reflux circulating in reflux pass $P_2$. It allows to appreciably increase the purity of the scrubbed gas while carrying along at least the $C_{2+}$fraction.

The temperature reached can be very low, of the order of −100° C., so as to eliminate the last ethane traces.

In all the realisation examples given above, the dephlegmator exchanger can be a brazed aluminium plate exchanger comprising a pass in which the gas circulates from the bottom upwards and where the velocity is such that the condensed liquid can circulate back down again by causing a distillation effect.

It can be advantageously inserted by means of a flange in the separating drum, so as to avoid the presence of pipes between the drum and the exchanger, and a distribution device on the exchanger, known to the man skilled in the art.

What is claimed is:

1. A process allowing to fractionate a gas comprising constituents referred to as heavy constituents and constituents referred to as light constituents, the gas being at a temperature $T_0$ initially and at a pressure $P_0$, characterized in that it comprises in combination at least the following stages:

a) cooling the gas from $T_0$ to a temperature $T_1$, b) separating a first gas phase from a first liquid phase obtained during cooling stage a), c) sending at least part of the first gas phase from separate stage b) to a first expansion stage so as to obtain a first mixed phase at a temperature $T_2$ and at a pressure $P_2$, d) sending the first mixed phase to a heat exchange stage (stage g) wherein it serves as a cooling agent, after which it is reheated, e) sending the first liquid $L_1$to a second expansion stage, f) sending the heated mixed phase and the expanded liquid phase to a separation stage so as to obtain a gas phase and a liquid phase, g) fractionating the gas phase by distillation performed by means of continuous heat exchange with the first mixed phase, extracting the light constituents as gas and the heavy constituents as condensates, the fractionating stage being carried out after the stage of expansion of the first mixed phase.

2. A process as claimed in claim 1, characterized in that the expanded liquid phase is sent to a stabilization stage so as to obtain stabilized condensates and a third gas phase to be fractionated, sent to separate stage f).

3. A process as claimed in claim 1, characterized in that at least part of the scrubbed gas from fractionating stage g) is used as an additional cooling agent for stage g).

4. A process as claimed in claim 1, characterized in that at least part of the scrubbed gas is used for cooling the gas during refrigeration stage a).

5. A process as in claim 1, characterized in that cooling in stage a) is performed so as to obtain a temperature below −15° C.

6. A process as claimed in claim 1, characterized in that expansion stage c) is carried out in order to obtain a gas at a pressure below 2 MPa.

7. A process as claimed in claim 1, characterized in that it comprises a dehydration stage before refrigeration stage a).

8. A process as claimed in claim 1, characterized in that it comprises a stage wherein said scrubbed gas is sent to a compression stage, at least a scrubbed and compressed gas fraction is diverted, said scrubbed and compressed gas fraction is sent to a refrigeration and expansion stage after which a second mixed phase is obtained, a second liquid phase is separated from a second gas phase, and the second liquid phase is used as reflux supplement for the distillation stage.

9. A process as claimed in claim 8, characterized in that said scrubbed and compressed gas fraction is cooled and liquefied to a temperature below −100° C.

10. A system for performing fractionation of a gas comprising constituents referred to as light constituents and constituents referred to as heavy constituents, comprising in combination:

gas refrigeration means and a separation device, at the outlet of which a first gas phase and a first liquid phase are obtained, first expansion means for expanding said first gas phase, at the outlet of which a first mixed phase at a temperature $T_2$ is obtained, said first expansion means being connected by a line to a heat exchange and distillation device allowing to perform heat exchange and distillation, said first mixed phase circulating through a first pass, first separation means for separating the first mixed phase after passage through the heat exchange and distillation device, second expansion means for expanding the first liquid phase, said second expansion means being connected to the separation means, in order to obtain a gas phase mixed with the gas phase resulting from separation of the mixed phase, all of the gas phases circulating through a second pass $P_2$, the gas phases in the first and second passes circulating in a countercurrent flow, a discharge line intended for the liquid phases obtained by separation in the separation means at least one discharge line intended for the higher constituents in the gas form, obtained by heat exchange and distillation in the heat exchange and distillation device.

11. A system as claimed in claim 10, characterized in that said device suited for heat exchange and distillation comprises a third pass suited for passage of at least part of the gas extracted through the at least one line.

12. A system as claimed in claim 10, characterized in that said device suited for heat exchange and distillation is a dephlegmator exchanger comprising at least two passes, including one reflux pass in which fractionation is carried out.

13. A system as claimed in claim 10, characterized in that it comprises stabilizaton means situated after the expansion valve.

14. A system as claimed in claim 13, characterized in that said stabilization means and the gas refrigeration means are included in the same device.

15. A system as claimed in claim 10, characterized in that the means intended for refrigeration and the means intended for separation of the gas to be fractionated are a stripper exchanger.

16. A system as claimed in claim 10, characterized in that said system comprises compression means for compressing the scrubbed gas, a line for diverting at least a fraction of the scrubbed gas, means intended for refrigeration and means intended for expansion of said fraction, and second separation means associated with the heat exchange and distillation device so as to obtain a liquid phase at a sufficiently low temperature, used as additional reflex in the second pass.

17. Application of the process as claimed in claim 1 for fractionation of a gas essentially comprising methane and hydrocarbons with one or more carbon atoms.

* * * * *